US005249974A

United States Patent [19]

Wang

[11] Patent Number: 5,249,974

[45] Date of Patent: Oct. 5, 1993

[54] MULTI-CONTACT CONNECTOR

[75] Inventor: Elson Wang, Hsin Chu, Taiwan

[73] Assignee: Pan-International Industrial Corp., Taipei, Taiwan

[21] Appl. No.: 945,243

[22] Filed: Sep. 15, 1992

[51] Int. Cl.[5] ..... H01R 13/648; H01R 9/09

[52] U.S. Cl. ..... 439/79; 439/607; 439/567

[58] Field of Search ..... 439/79, 80, 92, 95, 439/101, 571, 572, 607, 609, 610, 108, 567

[56] References Cited

U.S. PATENT DOCUMENTS 4,842,528 6/1989 Frantz ..... 439/80 X
4,857,017 8/1989 Erk ..... 439/79 X
5,076,795 12/1991 Krupp et al. ..... 439/79 X

*Primary Examiner*—Joseph M. Gorski
*Assistant Examiner*—Khan V. Nguyen
*Attorney, Agent, or Firm*—Jacobson, Price, Holman & Stern

[57] ABSTRACT

A connector includes a thin, insulative, flat base plate having terminals holes and elongated grooves for positioning of crimp terminals, a thin, flat cover board covered on the base plate for fastening and two angle plates secured to the casing by rivets to hold down the cover board to the base plate, wherein each angle plate has a plug rod for positioning on a printed circuit board, a round hole connected to either round hole on the casing by a rivet, and an opening on the respective bend to hold down either end projection on the cover board and the base plate.

3 Claims, 2 Drawing Sheets

MULTI-CONTACT CONNECTOR

BACKGROUND OF THE INVENTION

1. Field of the Invention

The present invention relates to connectors and relates more particularly to a thinner type connector to be fastened to a printed circuit board for connecting an external electronic device. The connector utilizes a flat insulative base plate covered with a flat cover board to hold crimp terminals in place, for permitting the parts thereof to be connected together by rivets, and therefore the total size and the manufacturing cost of the connector can be greatly reduced.

2. Description of the Prior Art

FIG. 3 illustrates a connector to which the present invention is pertained. The connector is generally comprised of a casing 20, which has two stub tubes 21 upstanding from the top edge adjacent to two opposite ends thereof, a plastic base plate 25, which has two through holes 26 through which the stub tubes 21 project respectively and a terminal holder 27 on the top, a plurality of crimp terminals 35 respectively inserted through terminal holes (not shown) on the plastic base plate 25 and mounted on the terminal holder 27, a top cover 30 covered on the terminal holder 27 of the plastic base plate 25 which has a plurality of bottom grooves 32 to hold the crimp terminals 35 in place, two mounting plates 24 which each has a through hole 29 respectively aligned with either through hole 26 on the plastic base plate 25 and either stub tube 21 on the casing 20, and two fastening elements 23 which connect each mounting plate 24 to either stub tube 21 in retaining the top cover 30, the plastic base plate 25 and the casing 20 together. The disadvantage of this structure of connector is the parts occupy much installation space relative to one another, and therefore the material cost as well as the total size of the connector can not be greatly reduced.

SUMMARY OF THE INVENTION

The present invention has been accomplished under the aforesaid circumstances. It is therefore an object of the present invention to provide a thinner type connector which requires less installation space. It is another object of the present invention to provide a thinner type connector which is inexpensive to manufacture and easy to install. By making the insulative base plate and the cover board in a respective flat structure and using rivets and slotted angle plates to fasten the insulative base plate and the cover board to the casing, the total height of the connector is greatly reduced.

DETAILED DESCRIPTION OF THE PREFERRED EMBODIMENT

Figure 1:
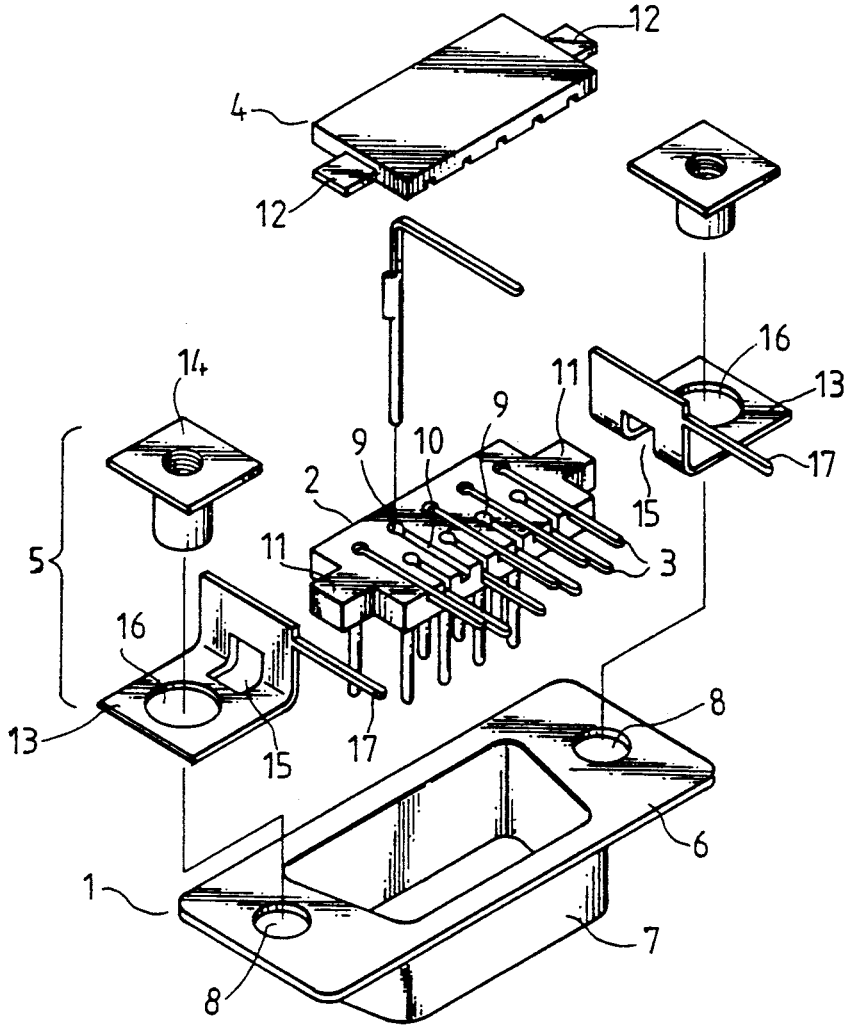
FIG. 1 is an exploded perspective view of the preferred embodiment of the connector of the present invention.

Referring to FIG. 1, the preferred embodiment of the present invention is generally comprised of a casing 1, an insulative base plate 2, crimp terminals 3, a cover board 4, and fastening devices 5. The casing 1 is comprised of a flat wall 6 having two round holes 8 adjacent to two opposite ends thereof, and a unitary adapter port 7 perpendicular to the flat wall 6. The insulative base plate 2 is made in the shape of a flat board having a plurality of terminal holes 9, a plurality of elongated grooves 10 on the top edge (surface) thereof respectively extended from either terminal hole 9 to the border, and two horizontal projections 11 on two opposite ends thereof. The cover board 4 is made from a flat board having two horizontal projections 12 at locations corresponding to the horizontal projections 11 on the insulative base plate 2. The fastening devices 5 each is consisted of an angle plate 13 and a rivet 14. The angle plate 13 has an opening 15 on the bend thereof, a hole 16 adjacent to one end thereof, and a unitary plug rod 17 projected from the border adjacent to one corner thereof for inserting into a respective hole on the printed circuit board to which the connector is to be connected.

Figure 2:
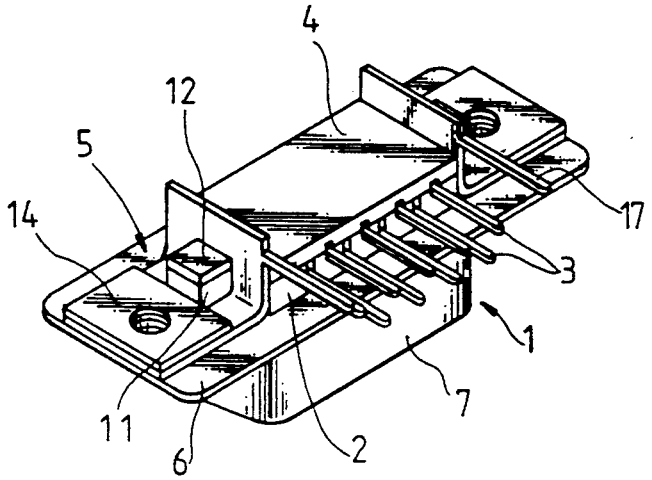
FIG. 2 is an elevational assembly view thereof.
Figure 3:
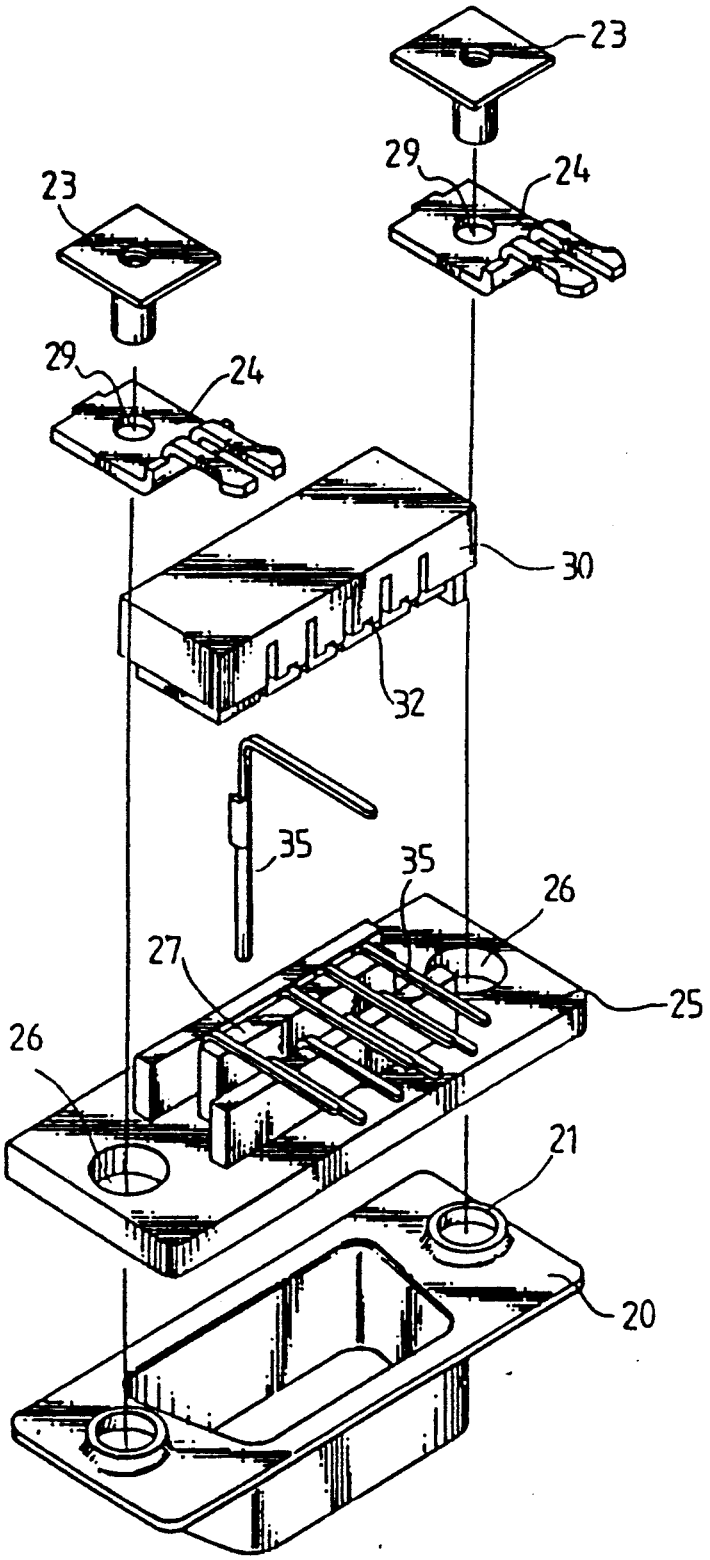
FIG.3 (PRIOR ART)
FIG. 3 is an exploded perspective view of a connector according to the prior art.

Referring to FIG. 2, crimp terminals 3 are respectively inserted through either terminal hole 9 and engaged in either groove 10 then secured in place by the cover board 4 with the horizontal projections 12 on the cover board 4 respectively overlapped over the horizontal projections on the insulative base plate 2 the insulative base plate 2 are secured to either round hole 8 on the flat wall 6 of the casing 1 by a respective fastening device 5. By inserting the overlapped horizontal projections 12,11 into the opening 15 of the angle plate 13 of either fastening device 5 and inserting the rivet 14 of each fastening device 5 through the hole 16 on the respective angle plate 13 and either round hole 8 on the casing 1 and hammering down the plain end of each rivet 14, the insulative base plate 2, the crimp terminals 3 and the cover board 4 become firmly retained to the flat wall 6 of the casing 1.

The flat design of the cover board 4 and the insulative base plate 2 greatly reduces the size and the manufacturing cost of the connector. By means of the fastening devices 5, the cover board and the insulative base plate 2 are positively secured to the casing 1.

As indicated, the present invention is to provide a "thinner structure of connector" which requires less installation space and is inexpensive to manufacture.

What is claimed is:

1. A connector comprising a casing having two round holes on a flat top wall thereof adjacent to two opposite ends of the top wall, an insulative base plate mounted on the flat top wall of said casing to hold a plurality of crimp terminals, a cover board covered on said insulative base plate to hold said crimp terminals in place, and two fastening devices to fasten said cover board and said insulative base plate to the flat top wall of said casing, wherein said insulative base plate comprises a plurality of terminal holes through which said crimp terminals are respectively inserted, a plurality of elongated grooves on a top surface thereof respectively extended from each terminal hole to an edge of said top surface to guide out each crimp terminal, and two horizontal projections on two opposite ends thereof; said cover board comprises two unitary, horizontal projections on two opposite ends thereof each respectively overlapping a horizontal projection of said insulative base plate; said fastening devices each is consisted of an angle plate and a rivet, the angle plate of each fastening device having an opening on a bend thereof sleeved on either two overlapped projections to hold down said cover board and said insulative base plate on the flat top wall of said casing, a hole adjacent to one end thereof aligned with either round hole on the flat top wall of said casing, and a unitary plug rod projected from an edge of the angle plate for inserting into a respective hole on a printed circuit board to which the connector is to be connected, the rivet of each fastening device comprising a cylindrical portion and a flat top portion connected thereto, with the cylindrical portion being inserted through the hole on the angle plate of the respective fastening device and each round hole on the flat top wall of said casing with the flat top portion being hammered down to firmly secure the respective angle plate to said casing.

2. The connector of claim 1 wherein said insulative base plate is made from a thin, flat plate.

3. The connector of claim 1 wherein said cover board is made from a thin, flat plate.

* * * * *